United States Patent [19]

Adachi

[11] 3,940,034

[45] Feb. 24, 1976

[54] CONTAINER

[76] Inventor: Mitiaki Adachi, 1167, Shimokurato-cho, Totsuka; Yokohama, Japan

[22] Filed: Nov. 19, 1973

[21] Appl. No.: 416,844

[30] Foreign Application Priority Data

Mar. 30, 1973 Japan ..... 48-38416

[52] U.S. Cl. ..... 222/478; 222/481.5

[51] Int. Cl.[2] ..... B67D 3/00

[58] Field of Search ..... 222/478, 481, 481.5, 530, 222/533, 538, 566, 527; 220/DIG. 13; 239/41 C

[56] References Cited

UNITED STATES PATENTS

| | | | |
|---|---|---|---|
| 1,878,348 | 9/1932 | Selle | 222/481 X |
| 1,913,895 | 6/1933 | Paull | 222/530 X |
| 2,083,776 | 6/1937 | Ferguson | 222/538 |

FOREIGN PATENTS OR APPLICATIONS

| | | | |
|---|---|---|---|
| 1,269,922 | 9/1960 | France | 220/DIG. 13 |

*Primary Examiner*—Robert B. Reeves
*Assistant Examiner*—Larry H. Martin
*Attorney, Agent, or Firm*—Gifford, Chandler & Sheridan

[57] ABSTRACT

A container provided with pipes which extend out from said container and which are arranged such that even when the container is turned on its side or in whatever manner, the root portion or the external opening of both of the pipes stay above the liquid level so that liquid will not flow out of the container.

2 Claims, 7 Drawing Figures

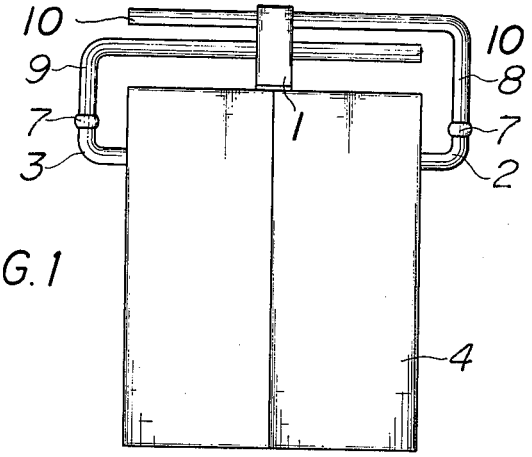
FIG. 1
FIG. 2
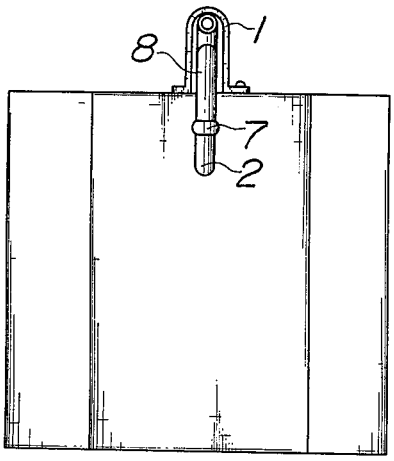
FIG. 3
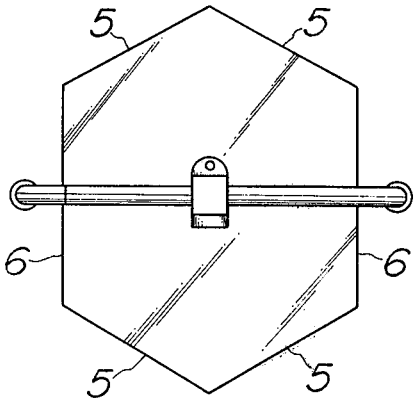
FIG. 4
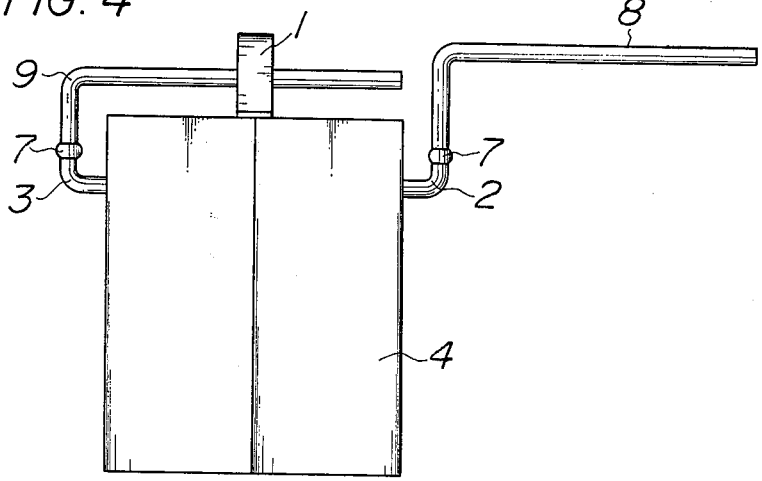

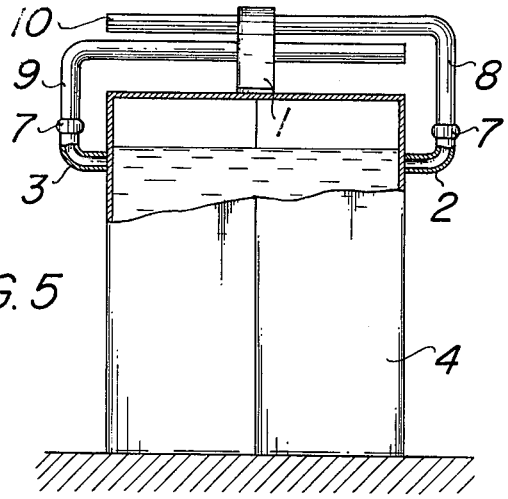
FIG. 5
FIG. 6
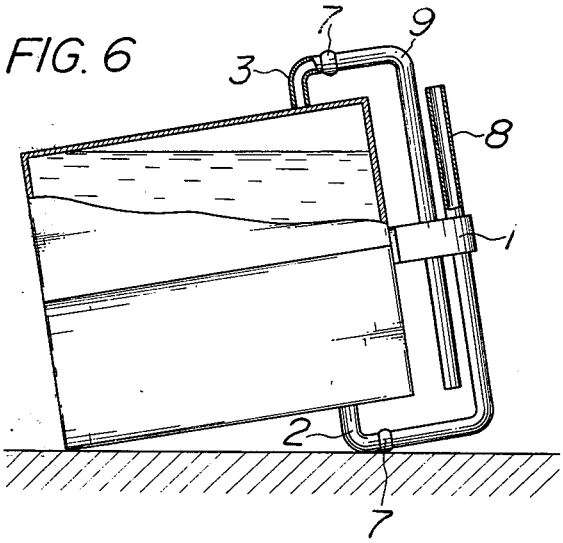
FIG. 7
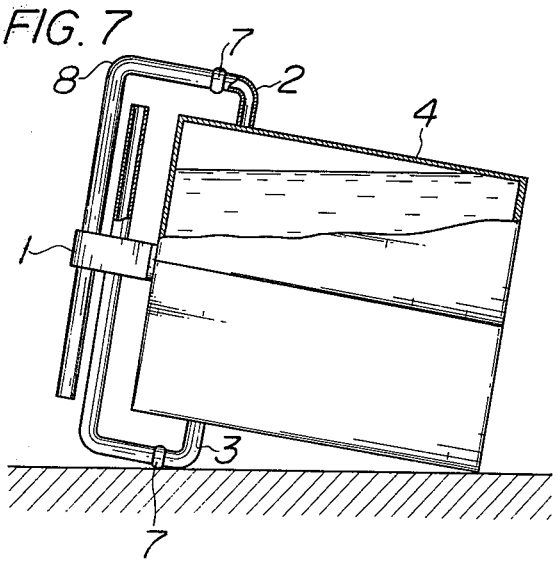

CONTAINER

BACKGROUND OF THE INVENTION

The present invention relates to a liquid container, and more particularly to a container arranged such that the liquid contained therein will not flow out even when the container is turned on its side.

There is currently available no container which is so constructed as to prevent outflow of the liquid content when the container is turned on its side.

SUMMARY OF THE INVENTION

The present invention provides a container which is specifically designed to prevent run-off of the liquid therein in the event of a fall or tumble of the container and which can be effectively utilized in many fields and for a variety of purposes both domestically and industrially.

DESCRIPTION OF THE DRAWINGS

The invention is now described in detail by way of an embodiment thereof while referring to the drawings, in which:

FIG. 1 is a front view of a container according to an embodiment of the present invention;

FIG. 2 is a side elevation;

FIG. 3 is a plane view;

FIG. 4 is a front view showing a situation where one of the pipes has been turned a half rotation (180°) for taking out the liquid;

FIG. 5 is a view, with parts shown in section, of the container in the normal state;

FIG. 6 is a view, with parts shown in section, of the container laid down to one side thereof; and FIG. 7 is a similar view of the container laid down to the other side.

DETAILED DESCRIPTION OF THE INVENTION

In the drawings, numeral 1 indicates a strap or band, 2 and 3 pipes, and 4 a container body. The container is preferably hexagonal in its top plan, with two pairs of, that is four, opposed sides of the hexagon being short sides 5 and the remaining one pair of, that is two, opposed sides being long sides 6. According to this arrangement, if a force is exerted on the container to turn it on its side, it is probable that the container will fall down with one of the long sides 6 acting as pivot, and it is infeasible that the container will fall pivotted by one of the short sides 5.

It will be also seen that pipes 2 and 3 extend from the lateral faces of the container below the respective long sides 6. Each of these pipes extends first laterally a certain distance and then is bent upwardly. To these pipes 2 and 3 are swivellably jointed at 7 the pipes 8 and 9, respectively, which extend upwardly and then are bent horizontally inwardly. Each joint 7 is of course water-tight. When it is desired to remove the liquid in the container, first the strap 1 is unfastened, then the pipe 8 or 9 is turned to direct it in the opposite direction and then the container is tilted.

Referring to FIGS. 6 and 7 it can be seen what happens when the container 4 is turned on its side by mistake or accidentally. It will be apparent that when the container falls down to any side thereof, the root portion 2 or 3 of one of the pipes 8 and 9 stays above the liquid level so that no liquid enters this pipe from the container. On the other hand, the other pipe will have its open end 10 positioned above the liquid level in the container, so that although the liquid may get into the pipe to some portion of its length, it cannot flow up to the open end of the pipe. To ensure this it is necessary that each of the pipes 8 and 9 be long enough to extend across the top face of the container to reach the long side 6 on the opposite side when the pipes are fastened by the strap 1.

The strap or band 1 may be of any type, though a button-fastened type is shown in the above embodiment.

Constructed as described above, the container according to the present invention can be utilized in all fields and for a variety of purposes, for both domestic and industrial uses.

I claim:

1. A container being hexagonal in top plan to provide at least a pair of opposed flat sides and a pair of shorter flat sides disposed intermediate said first mentioned flat sides, a pipe extending from each of said first mentioned flat sides adjacent an upper edge thereof, said pipes having an upwardly extending and a horizontally extending portion connected therewith, a swivel joint disposed in said upwardly extending portions whereby said horizontally extending portion can be rotated about said swivel joint, the horizontal portions of said pipes being of a length sufficient to extend completely across the top of said container, said pipes being completely open throughout their length to communicate with the interior of said container at all positions of aid pipe.

2. The container as defined in claim 1 and including means to fasten said pipes in position over the top of said container.

* * * * *

UNITED STATES PATENT OFFICE

CERTIFICATE OF CORRECTION

PATENT NO. : 3,940,034

DATED : February 24, 1976

INVENTOR(S) : Mitiaki Adachi

It is certified that error appears in the above-identified patent and that said Letters Patent are hereby corrected as shown below:

In the Statement of Priority:

Delete "48-38416" and insert --38416/73--.

Col. 1, line 28, delete "plane" and insert --top plan--.

Col. 2, line 47, delete "aid" and insert -- said --.

Signed and Sealed this

Third Day of August 1976

[SEAL]

*Attest:*

RUTH C. MASON
*Attesting Officer*

C. MARSHALL DANN
*Commissioner of Patents and Trademarks*